United States Patent [19]

Tavernier et al.

[11] Patent Number: 4,906,547

[45] Date of Patent: Mar. 6, 1990

[54] TRIBOELECTRICALLY CHARGEABLE MAGNETIC CARRIER PARTICLES HAVING MAGNETIC POWDER DISPERSED IN ACIDIC RESIN BASIC AMINO RESIN REACTION PRODUCT BINDER

[75] Inventors: Serge M. Tavernier, Lint; Pierre R. De Roo, Schoten, both of Belgium

[73] Assignee: Agfa-Gevaert N.V., Mortsel, Belgium

[21] Appl. No.: 284,362

[22] Filed: Dec. 14, 1988

[51] Int. Cl.[4] ..... G03G 9/10

[52] U.S. Cl. ..... 430/106.6; 430/108; 430/122

[58] Field of Search ..... 430/106.6, 108, 122

[56] References Cited

U.S. PATENT DOCUMENTS 4,247,597 1/1981 Russell ..... 430/108
4,299,898 11/1981 Williams et al. ..... 430/108
4,629,673 12/1986 Osawa et al. ..... 430/106.6
4,774,160 9/1988 Mahabadi et al. ..... 430/106.6

*Primary Examiner*—John L. Goodrow
*Attorney, Agent, or Firm*—William J. Daniel

[57] ABSTRACT

Magnetic carrier particles that can be positively charged triboelectrically and are suited for serving in magnetic brush toner-carrier development wherein said carrier particles comprise finely divided magnetically attractable powder dispersed in a resin binder which for at least 75% by weight consists of the acid-base reaction product of at least one acidic binder resin having an acid number in the range of 5 to 50 mg KOH/g, and at least one basic binder resin having free amin groups in an amount equivalent with 2 to 50 mg KOH/g and being present in an amount of at least 10% by weight with respect to such acidic resin.

16 Claims, No Drawings

TRIBOELECTRICALLY CHARGEABLE MAGNETIC CARRIER PARTICLES HAVING MAGNETIC POWDER DISPERSED IN ACIDIC RESIN BASIC AMINO RESIN REACTION PRODUCT BINDER

DESCRIPTION

The present invention relates to magnetic carrier particles for use in conjunction with toner particles in the development of electrostatic charge patterns.

A variety of electrostatic develops is available for use in developing electrostatic charge patterns. According to a known embodiment the developer comprises carrier particles and electroscopic marking or toner particles electrostatically adhering thereto. The carrier particles may comprise various materials and as the name implies, serve as a medium for carrying the electrostatically responsive marking particles to the charge pattern to be developed. Among the more common types of carrier-tone developers are dry developers known for use in magnetic brush development as described e.g. in U.S. Pat. No. 3,003,462.

The common magnetic brush development technique involves the use of magnetic means associated with a developing mixture composed of magnetic carrier particles carrying a number of smaller electrostatically adhering toner particles. In this technique the developer composition is maintained during the development cycle in a loose, brushlike orientation by a magnetic field surrounding, for example, a rotatable non-magnetic cylinder having a magnetic means mounted inside. The magnetic carrier particles are attracted to the cylinder by magnetic force and are arranged in a brushlike form. The toner particles are held to the carrier particles by virtue of their opposite electrostatic polarity obtained through triboelectricity. Before and during development, the toner acquires an electrostatic charge of a sign opposite to that of the carrier material due to triboelectric charging derived from their mutual frictional interaction. When this brushlike mass of magnetic carrier with adhering toner particles is drawn across the photoconductive surface bearing the electrostatic image, the toner particles are electrostatically attracted to an oppositely charged latent image and form a visible toner image corresponding to the electrostatic image.

In magnetic brush development carrier beads have normally a particle size in the range of 50–600 microns, whereas the toner particles usually have a diameter of about 10 microns.

A common type of carrier particles is made of iron or steel beads either or not covered with a suitable resin coating for providing a desired triboelectric contact with the toner particles.

In U.S. Pat. No. 4,,020,192 carrier particles on the basis of a steel core covered with an organic resin coating consisting of or containing a polymer containing monomer units having an amino group are described for use in conjunction with a wide variety of toner particles for providing thereto a triboelectric charge within an optimal range.

Such carrier particles are suited for development at moderate developing speeds but because of their density (about 7.7 g/cm3) suffer a fairly high mechanical inertia and a correspondingly too slow mixing capacity for use in fast operating devices or will undergo undesirable heating due to the high friction forces produced on mixing.

In U.S. Pat. No. 4,600,675 magnetic carrier particles are disclosed which have a much lower density and are composed preponderantly of fine magnetic powder dispersed in a binder resin. The magnetic powder is claimed to be a ferrite and the resin binder has hydrophilic functional groups in an amount such that the acid value of the resin binder is in the range of 5 to 250 mg KOH/g, the weight ratio of magnetic powder to resin binder being in the range of 350–800 to 100. Carrier particles containing a ferrite and the above defined resin binder having free acid groups exhibit a triboelectric character that makes them suited for charging toners negatively. Positive charged toner particles are suited for use in positive-positive image reproduction on photoconductive recording layers that before image-wise photo-exposure were negatively charged. They are not suited for use in reversal development on such recording layers wherein the initially charged areas have a negative charge sign. Reversal development is associated with the production of charge patterns by induction.

In electrophotography a charge pattern can be obtained by induction through a properly biased developing electrode inducing charges in the light-discharged areas. In reversal development the charge pattern obtained by induction attracts the toner particles, whereas in the non-light exposed areas the initial charge is at least partly neutralized by the induced charge so that therein no electrostatic toner attraction and even some toner repellance takes place (ref. R.M. Schaffert in the book "Electrophotography" -The Focal Press - London, New York, enlarged and revised edition 1975, pp. 50–51). An induced charge pattern of positive charge sign will only be developable with negatively charged toner. For example, induced charge patterns of positive charge sign are obtained with negative bias electrode in combination with originally negatively charged organic photoconductive recording elements. A poly-N-vinylcarbazole trifluorenone complex is an example of negatively chargeable photoconductor (ref. U.S. Pat. No. 4,242,434).

Reversal development is preferred when the exposure proceeds in the negative image recording mode using e.g. an image-wise modulated laser beam.

As is the case in any carrier-toner development, also in magnetic brush development the carrier-toner mixture undergoes mechanical abrasion resulting in physical degradation of the carrier particles mainly because of poor mechanical strength of the binder composition and lack of good adherence to the magnetic material.

It is an object of the present invention to provide carrier particles comprising magnetic particles dispersed in a binder resin composition that by triboelectricity will obtain a positive charge sign in conjunction with toner particles receiving a negative charge sign.

It is an other object of the present invention to provide carrier particles comprising magnetic particles dispersed in a binder resin composition having high resistance against abrasion.

It is a further object of the present invention to provide carrier particles comprising magnetic particles dispersed in a polymeric binder having chemical affinity towards said magnetic particles and strong adherence thereto.

Other objects and advantages will become apparent from the hereinafter following description and examples.

In accordance with the present invention a particulate material suited for serving as carrier particles in magnetic brush toner-carrier development of electrostatic charge patterns is provided, said particles comprising finely divided magnetically attractable powder dispersed in a resin binder matrix, characterized in that the binder consists for at least 75% by weight of a mixture of at least one acidic binder resin having an acid number in the range of 5 to 50 mg KOH/g, and at least one basic binder resin having free amino groups in an amount equivalent with 2 to 50 mg KOH/g and being present in an amount of at least 10% by weight with respect to the acidic resin(s), and wherein during the obtaining of said mixture of an acid-base reaction between acidic binder resin and basic binder resin has taken place.

The content of magnetically attractable powder in the carrier particles is preferably at least 70% by weight of the total carrier content.

The size of said carrier particles is preferably in the range of 15 to 150 μm.

Examples of acidic binder resins suitable for use according to the present invention are: addition or condensation polymers having groups of acidic nature such as a carboxylic acid groups, sulphonic acid groups and phenol-type hydroxy groups. More particularly are mentioned vinyl type addition polymers possessing in their structure said acidic groups introduced by random copolymerization or graft-copolymerization, e.g. copolymers of lower alkyl esters of acrylic acid and/or styrene with unsaturated acids such as acrylic acid, methacrylic acid, maleic acid and itaconic acid or copolymers of butadiene wherein said groups have been introduced by graft-copolymerization.

Preferred acidic condensation polymers for use according to the present invention are acidic polyester resins, e.g. those produced by condensation reaction of a polyol or mixture of polyols, e.g. ethylene glycol, triethylene glycol and an alkoxylated bisphenol, especially bisphenol A, i.e. [2,2-bis(4-hydroxyphenyl)-propane], with a dicarboxylic acid or mixture of dicarboxylic acid, e.g. maleic acid, fumaric acid, itaconic acid, malonic acid, isophthalic acid and optionally partly of a polyacid having at least 3 carboxylic acid groups such as trimellitic acid yielding some crosslinking.

The preparation of linear polyester resins of the above type is described in GB-P No. 1,373,220.

A particularly useful acidic polyester binder is derived from terephthalic acid that is polycondensed with less than 1 equivalent of an ethoxylated and/or propoxylated "bisphenol A".

The synthesis of partly crosslinked polyesters is described e.g. in published GB-No. 2082788A patent application disclosing toner comprising as a binder a polyester resin obtained from a diol or mixture of diols represented by the following general formula:

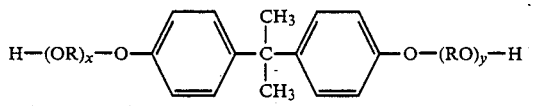

where R represents an ethylene or propylene group, x and y are independent numbers such that the average value of their sum is 2 to 7; and a polycarboxylic acid or derivative thereof, which is a mixture of a dicarboxylic acid or a $C_{1-6}$ alkyl ester thereof and a tri- or polycarboxylic acid or an acid anhydride thereof, the content of said tri- or polycarboxylic acid or acid anhydride being from 30 to 80 mol% of the acids.

It has been established experimentally that the resistance to abrasion of carrier particles containing iron oxide type magnetic particles is particularly good when slightly cross-linked polyester resins having an acid number as defined are used.

Alkaline or basic polymers suited for use according to the present invention contain free amino groups in an amount at least equivalent with 2 g of KOH per gram and up to 50 g of KOH per gram. These polymers are e.g. vinyl type addition polymers containing free amino groups, polyethyleneimine, condensation polymers of the polyamide type having an excess of free amino groups and amino-aldehyde resins, e.g. melamine-formaldehyde resins having an excess of free amino groups.

Particularly useful basic addition polymers are homo- or copolymers including monomer units corresponding to one of the following structural formulae (I), (II) or (III):

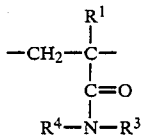

(I)

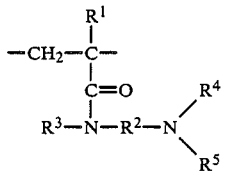

(II)

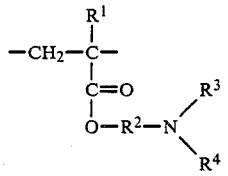

(III)

wherein:

$R^1$ represents hydrogen or methyl, $R^2$ represents a bivalent hydrocarbon group, e.g. an alkylene group having from 1 to 12 carbon atoms, and $R^3$, $R^4$ and $R^5$ —same or different - represent hydrogen or a hydrocarbon group, e.g. a C1–C12 hydrocarbon group.

The basic addition polymers include one of said monomer units preferably in an amount of at least 1% by weight.

Monomers of the above type and their polymerization are described in detail in U.S. Pat. No. 4,020,192. Preferred examples of said addition polymers contain monomer units according to the above general formula (III) such as methyl methacrylate ester of N,N'-dimethyl ethanolamine.

In copolymers including at least one of said monomer units other monomer units are e.g. styrene and styrene homologues, acrylate and methacrylate esters, acrylamide, acrylonitrile, methacrylonitrile, vinyl chloride and vinyl acetate.

Magnetically attractable powder suited for use in carrier particles according to the present invention has preferably a particle size in the range of 0.05 to 3.0 μm.

Preferred magnetically attractable powder particles are iron oxide particles having a specific gravity lower than 6, e.g. $Fe_2O_3$ or $Fe_3O_4$ (magnetite) or are ferrites. Suitable ferrites are described e.g. in U.S. Pat. No. 4,546,060 and 4,600,675.

Ferrite material is represented by the following general formula:

$$M\frac{1-x}{1+x}(1-y)Fe\frac{2x}{1+x}(1-y)Oy$$

wherein:

M denotes at least one atom selected from the group consisting of Mn, Ni, Co, Mg, Cu, Zn and Cd, and x and y are numeric values satisfying $0.5 \leqq x \leqq 1$ and $0.1 \leqq y \leqq 0.571$.

According to a preferred embodiment finely divided magnetically attractable powder is used as a mixture of magnetites wherein one type (A) of the magnetite has an oil absorption number in the range of 10 to 20 g/100 g pigment and another type (B) of the magnetite has an oil absorption number in the range of more than 20 to 40 g/100 g pigment.

The oil absorption value provides information as to the binder and solvent requirement of a pigment or a coating mix made thereof.

The oil absorption number is measured according to the method described in DIN 53199, proceeding as follows:

The pigment involved in the test is applied to a roughened glass plate. The weight of the sample weighed (2–10 g) depends on the oil absorption expected. To start, ⅔ of the required quantity of untreated linseed oil (to DIN 55930, acid value at least 3) is added from a burette, then being intensively mixed with a spatula and processed under pressure until the mass is homogeneous. Oil is then added drop-by-drop, until a cohesive, putty-like mass is obtained which can just not quite be spread on the glass plate. The quantity of oil required for this purpose is accurately read off in ml.

$$\text{oil absorption} = \frac{\text{oil quantity (ml)} \times 0.93 \times 100}{\text{pigment weight (g)}}$$

The preparation of magnetite particles having a low oil absorption (i.e. lower than 20 g/100 g pigment) is described in published European Patent Application No. 0 187434.

Preferred magnetic pigments have a saturation magnetization in emu/g of 65–110, have a coercitivity in Oe of 60–250, have a remanence in emu/g of 5 to 15 and a specific resistivity of at least $10^5$ ohm.cm.

The above mentioned magnetic data were measured on a vibration magnetometer operating with a field strength of 3.5 kOe and the density was determined with a pycnometer. A density value of 4.6 g/m2 was measured.

The induced magnetic moment of at least 20 emu/g in an applied field of 1,000 gauss equivalent to 0.1 tesla (T), makes that, as described in U.S. Pat. No. 4,546,060, the carrier particles are withheld on the magnetic brush developer roller sleeve and do not transfer to the image with the toner. Embodiments of magnetic brush development are illustrated in FIG. 2 of Physics Today, May 1986, p. 48, and in FIG. 1 of U.S. Pat. No. 4,600,675.

The magnetic carrier particles according to the present invention can be produced by dispersing the magnetic powder in the resin binder melt, allowing to solidify the molten dispersion and crushing and milling the obtained solid. By wind sifting or sieving particles sized preferably in the range of 15 to 150 μm are separated.

In order to improve the mixing of the magnetic attractable powder particles with the binder melt, the particles have preferably a spherical or spheroidal shape. The production of spherical magnetite powder is described in published EP-A No. 0 187 434.

According to a particular embodiment the magnetically attractable powder particles are incorporated in the binder matrix in combination with carbon black controlling in that way the specific resistivity of the carrier particles. A suitable amount of carbon black is in the range of 02. to 5 % by weight with respect to the magnetite.

In order to obtain particles with good flowing properties flow enhancing agents can be melt-mixed within the carrier composition yielding a carrier particle surface provided with small spacer particles, that are optionally embedded therein after the milling process. Suitable flow improving agents are e.g. colloidal silica and $Al_2O_3$-particles of sub-micron particle size. Another way to improve the flowing properties is by producing carrier particles having a spherical or spheroidal shape.

Such shapes can be achieved by spraying a melt and solidifying it in droplet form or according to a heating-dispersion technique described in U.S. Pat. No. 4,345,015. According to the latter technique carrier particles obtained by crushing are dispersed in a liquid in which the resin binder does not dissolve in the presence of colloidal hydrophobic silica in a concentration to inhibit coagulation of the particulate material when heat-softening the resin binder; the dispersion is heated with stirring to a temperature at which the resin of the particles softens but does not melt and the particles acquire a spherical or spheroidal shape. The dispersion is then cooled down to a temperature at which the resin binder of the particles is no longer sticky,and finally the carrier particles are separated, e.g. by filtering or centrifuging and dried. The amount of hydrophobic colloidal silica generally ranges from 0.2 to 2.0 parts by weight per 100 parts by weight of carrier particles and has no detrimental influence on triboelectric properties, and further promotes flowing properties as explained above by being partially embedded in the carrier surface.

The toner for use in combination with carrier particles of the present invention can be selected of a wide variety of materials, including both natural and synthetic resins and charge controlling agents as disclosed e.g. in U.S. Pat. No. 4,076,857 and U.S. Pat. No. 4,546,060. Suitable resins for toner production are e.g. cumarone-indene resins, phenol-formaldehyde resin, rosin-modified phenol formaldehyde resin, polypropylene, epoxy resin, polyester resins derived from fumaric and isophthalic acid as described e.g. in U.S. Pat. No. 4,525,445, or copolymer derived from styrene or styrene homologue and an alkyl acrylate or alkyl methacrylate monomer in conjunction with a crosslinking monomer comprising at least two ethylenically unsaturated groups as described in EP-A Nr. 87200288.6.

The shape of the toner particles can be irregular, as is the case in ground toners, or spheroidal. Spheroidization may proceed by spray-drying or by the heat-dispersion process disclosed in U.S. Pat. No. 4,345,015.

In the following illustrative examples all parts, ratios and percentages are by weight unless otherwise indicated.

EXAMPLE 1

The following mixture was melt-kneaded for 30 min thus obtaining a steady state mixing temperature of 160° C.:

(1) 12.5 parts of a partially crosslinked polyester of ethoxylated bisphenol A polycondensed with a mixture of isophthalic acid and a minor amount of benzene-1,2,4-tricarboxylic acid, said polyester being characterized by a softening point of 137° C. (ring and ball method), glass transition temperature of 68° C. , and acid value 26 mg KOH/g, (2) 7.5 parts of a statistical addition polymer being a copolymer of styrene, ethylhexyl acrylate and 1-dimethylamino-ethyl methacrylate (79/20/1) having an alkalinity equivalent with 3.5 mg KOH/g and a glass transition temperature of 58° C.

(3) 59 parts of spheroidal magnetite A having an oil absorption number of 16, having an average particle size of 0.5 μm, magnetization saturation in emu/g of 81 and remanence in emu/g of 8.1, said magnetite being sold under the trade name BAYFERROX of Bayer AG, W. Germany, and (4) 28 parts of spheroidal magnetite B having an oil absorption number of 31, having an average particle size of 0.2 μm, maximum saturation magnetization of 84 emu/g and remanence in emu/g of 8.2 said magnetite being sold under the trade name MAPICO Black 200 by Titan Kogyo, Japan.

Excellent mixing-homogenization was obtained as was seen under the microscope.

After cooling the kneaded mass was pulverised in an impact mill and powder particles sizing between 36 and 100 μm were separated by sieves of suited mesh.

The magnetic properties, viz. magnetization remanence in emu/g at 3750 gauss (B 3750) and coercitive force (Hc) in Oe of the carrier were measured and the results are shown in Table 1 following the examples.

The obtained carrier particles were used in magnetic brush development in combination with toner particles prepared as described in Example 1 of published European Patent Application No. 0279960 in a carrier/toner weight ratio of 100:12.

The binder of the toner particles was copoly(-styrene/n-octadecylmethacrylate/ethylene glycol dimethacrylate)(82.6/16/1.4 wt.%) the preparation of which proceeded as follows:

In a double-wall 10 l glass-reactor provided with stirrer, thermometer, reflux condenser, nitrogen inlet, cooling spiral and thermostatic device for controlling the reaction temperature were introduced:

5000 ml of demineralized water and 50 g of copoly(-vinyl alcohol/vinyl acetate)(80/20 wt.) as dispersing aid. The solution was heated to 90° C. while stirring and introducing nitrogen gass. At that temperature over a period of 20 min the following ingredients were introduced:

| | |
|---|---|
| benzoylperoxide | 37.5 g |
| styrene | 826 g |
| n-octadecyl methacrylate | 160 g |
| ethylene glycol dimethacrylate | 14 g |

Polymerization was carried on for 20 h at 90° C. while stirring.

After cooling the formed pearls were separated by suction filtering, once washed with water and twice with methanol. The copolymer pearls were dried at 40° C. up to constant weight value. Polymer yield about 85% of the theoretical value.

The toner preparation proceeded as follows:

88.25 parts of the above copolymer, 6 parts of carbon black (average particle size 25 nm), 0.75 parts of BONTRON S36 (trade name of Oriental Chemical Industries, Japan, for a metal complex dye) as negative charge controlling agent and 5 parts of isotactic polypropylene (melting point: Tm=145 ° C. ) were mixed in a kneader and heated at 153° C. to form a melt.

After about 30 minutes the kneading was stopped and the mixture was allowed to cool to room temperature (20° C.). At that temperature the mixture was crushed and milled to form a powder. The obtained powder was further reduced in grain size by jet mill to obtain an average particle size of 9 μm.

To improve the flow properties of the toner 0.2 parts of colloidal silica (average particle size 20 nm) were admixed thereto. Viscosity: 70.2 Pa.s measured at 190° C. as defined herein.

The tribo-electric charge of the carrier particles was positive and on the toner particles negative. The toner charging was determined by blow-off methods and yielded −4.25 μC/g.

The developer was used for reversal development of an originally negatively charged organic photoconductor. High quality prints were realised with good solid blacks and high sharpness for more than 120,000 copies.

EXAMPLE 2

(comparative example)

Example 1 was repeated using 17.5 parts of the partially cross-linked polyester as the sole binder resin in combination with 53.5 parts of magnetite A and 29 parts of magnetite B. The mixture was melt-kneaded for 30 min. Thus obtaining a steady state mixing temperature of 170° C. and resulted in a good homogenization as could be seen under microscope.

As in Example 1 the thus obtained carrier particles were combined with toner particles prepared as described in Example 1 of published European Patent Application No. 0279960 in a carrier/toner weight ratio of 100:12.

The toner charging was determined by blow-off methods and yielded −1.40 μC/g.

In magnetic brush development as described in Example 1 prints with marginal quality with high background tone deposition were obtained.

EXAMPLE 3

(comparative example)

Example 1 was repeated using 16 parts of the basic copolymer 2) as sole binder resin in combination with 54.5 parts of magnetite A and 29.5 parts of magnetite B. The mixture as melt-kneaded for 30 min thus obtaining a steady state mixing temperature of 141° C. but resulted in bad homogenization as was observed under microscope.

As in Example 1 obtained particles were combined with toner particles prepared as described in Example 1 of published European Patent Application No. 0279960 in a carrier/toner weight ratio of 100:12.

The charging of the toner was determined by blow-off method as described in Example 1 and yielded −4.9 μC/g.

In magnetic brush development as described in Example 1 initially prints with good quality were obtained but rather quickly deterioration of the organic photoconductor layer was observed.

EXAMPLES 4-10

The preparation of the carrier particles of Example 1 was repeated with a different amino-containing copolymer, viz. a copolymer of butyl methacrylate, methyl methacrylate and t-butylaminoethylmethacrylate (63/32/5) having an equivalent acid value of 15 mg KOH/g.

The total amount of binder present was 20% with respect to 52% of magnetite A and 28% of magnetite B.

The ratio of amine-containing copolymer with respect to polyester was varied as indicated in Table 2 wherein also the obtained toner charge with the resulting carrier particles is given.

EXAMPLE 11

The carrier particles obtained as described in Example 1 were subjected to a spheroidization process by dispersing the particles in an ethanol/water mixture (⅓ by volume), the concentration of carrier being 200 g/. Spheroidization was obtained by heating the dispersion to 73° C. for 30 min, under vigourous stirring. After cooling, the dispersion was filtered, the carrier beads washed, magnetically separated and dried. Inspection under a microscope revealed no agglomeration and successful spheroidization.

A substantial improvement in developer flowability was obtained.

The obtained toner charge by blow-off technique was −4.1 μC/g.

TABLE 1

| Example | B 3750 (emu/g) | Br (emu/g) | Hc (Oe) |
|---|---|---|---|
| 1 | 69.3 | 11.7 | 92 |
| 2 | 72.5 | 11.6 | 70 |
| 3 | 69 | 10.5 | 108 |
| 4–10 | 67.5 | 8.4 | 114 |
| 11 | 70.5 | 10.7 | 95 |

TABLE 2

| Example | polyester parts wt | amino resin parts wt | Temperature kneader °C. | toner charge μC/g |
|---|---|---|---|---|
| 4 | 20 | 0 | 163 | −3.5 |
| 5 | 18 | 2 | 177 | −4.5 |
| 6 | 16 | 4 | 185 | −4.5 |
| 7 | 14 | 6 | 185 | −7.0 |
| 8 | 12 | 8 | 186 | −15.0 |
| 9 | 10 | 10 | 175 | −3.5 |
| 10 | 0 | 20 | 177 | −2.6 |

We claim:

1. A particulate material suited for serving as carrier particles in magnetic brush toner-carrier development of electrostatic charge patterns, said particles comprising finely divided magnetically attractable powder dispersed in a resin binder matrix, characterized in that the binder consists of at least 75% by weight of an acid-base reaction product of at least one acidic binder resin having an acid number in the range of 5 to 50 mg KOH/g, and at least one basic binder resin having free amino groups in an amount equivalent with 2 to 50 mg KOH/g and being present in an amount of at least 10% by weight with respect to such acidic resin.

2. A particulate material according to claim 1, wherein the content of magnetic powder in the carrier particles is at least 70% by weight of the total carrier content.

3. A particulate material according to claim 1, wherein the size of said carrier particles is in the range of 15 to 150 μm and said magnetic powder has a size in the range of 0.05 to 3.0 μm.

4. A particulate material according to claim 1, wherein each such acidic binder resin is an addition or condensation polymer having acidic groups selected from the group consisting of carboxylic acid groups, sulphonic acid groups and phenol-type hydroxy groups.

5. A particulate material according to claim 4, wherein each such acidic resin binder is an acidic polyester resin produced by condensation reaction of a polyol or mixture of polyols with a dicarboxylic acid or mixture of dicarboxylic acids and optionally partly a polyacid having at least 3 carboxylic acid groups yielding some crosslinking.

6. A particulate material according to wherein claim 5, wherein the acidic polyester binder is derived from terephthalic acid that is polycondensed with less than 1 equivalent of an ethoxylated and/or propoxylated "bisphenol A".

7. A particulate material according to claim 1, wherein each such basic binder resin is selected from the group consisting of vinyl type addition polymers containing free amino groups, polyethyleneimines, condensation polymers of the polyamide type having an excess of free amino groups and amino-aldehyde resins having an excess of free amino groups.

8. A particulate material according to claim 7, wherein each such basic binder resin is a homo- or copolymer including monomer units corresponding to one of the following general formulae (I), (II) or (III):

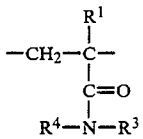
(I)

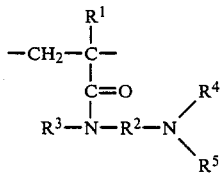
(II)

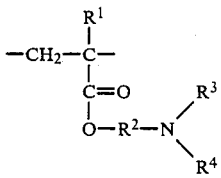
(III)

wherein:

$R^1$ represents hydrogen or methyl, $R^2$ represents a bivalent hydrocarbon group, and $R^3$, $R^4$ and $R^5$, which may be the same or different, represents hydrogen or a hydrocarbon group.

9. A particulate material according to claim 1, wherein the magnetically attractable powder has a particle size in the range of 0.05 to 3.0 μm.

10. A particulate material according to claim 1, wherein the magnetically attractable powder particles are iron oxide particles having a specific gravity lower than 6 and are selected from the group consisting of $Fe_2O_3$, $Fe_3O_4$ (magnetite) and a ferrite.

11. A particulate material according to claim 10, wherein a mixture of magnetites is present wherein one type (A) of the magnetite has an oil absorption number in the range of 10 to 20 g/100 g pigment and another type (B) of the magnetite has an oil absorption number in the range of more than 20 to 40 g/100 g pigment.

12. A particulate material according to claim 11, wherein the magnetites have a saturation magnetization in emu/g of 65–110, have a coercitivity in Oe of 60–250, have a remanence in emu/g of 5 to 15 and a specific resistivity of at least $10^5$ ohm.cm.

13. A particulate material according to claim 1, wherein the carrier particles have a spherical or spheroidal shape.

14. A particulate material according to claim 1 wherein the acid-base reaction product of said acidic and basic binder resins is produced in the presence of said finely-divided magnetically attractable powder.

15. A triboelectrically chargeable developer composition for developing electrostatic charge patterns comprising a mixture of the carrier particles of claim 1 and finely-divided toner particles adapted to be electrostatically attracted to said charge pattern.

16. The composition of claim 15 wherein said carrier particles have a size in the range of about 15 to 150 μm and said toner particles have a size up to about 10 μm.

* * * * *

UNITED STATES PATENT AND TRADEMARK OFFICE

CERTIFICATE OF CORRECTION

PATENT NO. : 4,906,547

DATED : MARCH 6, 1990

INVENTOR(S) : Serge Martin Tavernier et al.

It is certified that error appears in the above-identified patent and that said Letters Patent is hereby corrected as shown below:

In the Claims:

Column 10, line 27, Claim 6, after "to" cancel --wherein--;
Column 11, line 2, Claim 8, change "represents" to --represent--.

Signed and Sealed this

Nineteenth Day of March, 1991

*Attest:*

HARRY F. MANBECK, JR.

*Attesting Officer*

*Commissioner of Patents and Trademarks*